US006648074B2

(12) United States Patent
Finn et al.

(10) Patent No.: US 6,648,074 B2
(45) Date of Patent: Nov. 18, 2003

(54) GIMBALED TABLE RISER SUPPORT SYSTEM

(75) Inventors: Lyle D. Finn, Sugar Land, TX (US); Himanshu Gupta, Houston, TX (US)

(73) Assignee: Coflexip S.A., Paris (FR)

( * ) Notice: Subject to any disclaimer, the term of this patent is extended or adjusted under 35 U.S.C. 154(b) by 90 days.

(21) Appl. No.: 09/968,076

(22) Filed: Oct. 1, 2001

(65) Prior Publication Data

US 2002/0084077 A1 Jul. 4, 2002

Related U.S. Application Data

(63) Continuation-in-part of application No. 09/677,814, filed on Oct. 3, 2000.

(51) Int. Cl.[7] ..... E21B 43/017

(52) U.S. Cl. ..... 166/350; 405/224.3; 405/224.4; 166/355; 166/382

(58) Field of Search ..... 166/366–368, 166/350, 355, 358, 382; 405/223.1, 224, 224.2–224.4

(56) References Cited

U.S. PATENT DOCUMENTS

| | | | | |
|---|---|---|---|---|
| 4,913,238 | A | * | 4/1990 | Danazcko et al. |
| 4,995,762 | A | * | 2/1991 | Goldman |
| 5,330,293 | A | * | 7/1994 | White et al. |
| 5,427,180 | A | | 6/1995 | Leite et al. |
| 5,439,321 | A | * | 8/1995 | Hunter |
| 5,683,205 | A | | 11/1997 | Halkyard |
| 5,873,677 | A | | 2/1999 | Davies et al. |

FOREIGN PATENT DOCUMENTS

| | | |
|---|---|---|
| EP | 0 390 728 A2 | 10/1990 |
| WO | WO 99/50136 | 10/1999 |
| WO | WO 01/16458 A1 | 3/2001 |

* cited by examiner

*Primary Examiner*—Roger Schoeppel
(74) *Attorney, Agent, or Firm*—Klein, O'Neill & Singh, LLP

(57) ABSTRACT

For a spar type floating platform having risers passing vertically through the center well of a spar hull, there is provided apparatus for supporting the risers from a gimbaled table supported above the top of the spar hull. The table flexibly is supported by a plurality of non-linear springs attached to the top of the spar hull. The non-linear springs compliantly constrain the table rotationally so that the table is allowed a limited degree of rotational movement with respect to the spar hull in response to wind and current induced environmental loads. Larger capacity non-linear springs are located near the center of the table for supporting the majority of the riser tension, and smaller capacity non-linear springs are located near the perimeter of the table for controlling the rotational stiffness of the table. The riser support table comprises a grid of interconnected beams having openings therebetween through which the risers pass. The non-linear springs may take the form of elastomeric load pads or hydraulic cylinders, or a combination of both. The upper ends of the risers are supported from the table by riser tensioning hydraulic cylinders that may be individually actuated to adjust the tension in and length of the risers. Elastomeric flex units or ball-in-socket devices are disposed between the riser tensioning hydraulic cylinders and the table to permit rotational movement between the each riser and the table.

16 Claims, 15 Drawing Sheets

GIMBALED TABLE RISER SUPPORT SYSTEM

CROSS-REFERENCE TO RELATED APPLICATIONS

This application is a Continuation-in-Part of U.S. patent application Ser. No.09/677,814, filed Oct. 3, 2000, to which application priority is claimed.

STATEMENT REGARDING FEDERALLY SPONSORED RESEARCH OR DEVELOPMENT

Not applicable.

BACKGROUND OF THE INVENTION

1. Field of the Invention

The present invention relates to offshore mineral drilling and production platforms of the spar type and, more particularly, is concerned with apparatus for supporting drilling and production risers from a gimbaled table supported above the top of the spar hull wherein the table is compliantly constrained, but allowed limited rotational movement with respect to the spar hull. The Continuation in Part application is also concerned with an improved and simplified keel joint for the spar type platform, and a yaw limiting apparatus for the gimbaled table.

2. Description of the Prior Art

Drilling and production operations for the exploration and production of offshore minerals require a floating platform that is as stable as possible against environmental forces, even in severe weather conditions. Among the six degrees of freedom of a floating platform, the most troublesome to drilling and production operations are the pitch, heave, and roll motions.

Present spar type floating platforms typically have drilling and production risers that are supported by means of buoyancy cans attached to each of the individual risers. As the water depth in which a platform will be used increases, the diameter and length of the buoyancy cans must be increased to support the in-water weight of the risers and their contents. Larger diameter buoyancy cans require larger spar center well sizes, which in turn increases the spar hull diameter. Increasing the spar hull diameter and size in turn increases the hydrodynamic environmental loads acting on the spar. A larger size mooring system is then required to withstand the increased environmental loads. The total riser buoyancy can system for deep-water spar platforms can become very long and heavy, significantly increasing the fabrication and installation costs.

With present spar platforms having a buoyancy can riser support system, as the spar hull displaces laterally in response to environmental loads, the risers undergo a considerable amount of downward motion, or pull-down, with respect to the spar hull. This amount of riser pull-down increases as the water depth and riser length increases, and requires longer jumper hoses, large clear vertical heights between the top of the hull and the drilling deck, and expensive, large stroke keel joints.

Consequently, a need exists for improved apparatus for supporting drilling and production risers from a spar type floating platform. Preferably, such an improved apparatus will eliminate the need for riser buoyancy cans. It will preferably also reduce the amount of riser pull-down relative to the spar hull as the spar pitches and displaces in response to environmental forces. Such an improved riser support apparatus will also preferably reduce the amount of fixed ballast required, reduce the need for, or length of, riser jumper hoses, and reduce the size and diameter of the spar hull. It will also preferably be less expensive to build, install, and maintain than individual riser buoyancy can systems in present use.

With respect to the Continuation in Part application, the keel joint described in U.S. Pat. No. 5,683,205 to Halkyard for "Stress Relieving Joint for Pipe and Method" consists in a guiding sleeve where the vertical riser passes through. The sleeve, by having rings at each open end for engagement with the riser, allows the sleeve to distribute the bending stress at two spaced areas on the riser. The sleeve is also provided with wear means for contact with the keel. U.S. Pat. No. 5,873,677 to Davies for "Stress Relieving Joint for Riser" consists in a rotating keel joint having a ball joint fixedly attached to the keel opening. The sleeve of the riser is connected to the ball joint and wear means are provided between the sleeve and the riser.

However, there are several problems with keel joints of the prior art. First, they require long lengths of stress relieving sleeve. Prior art keel joints are also complex and expensive to build. Therefore, a need exists for and improved and simplified keel joint for the spar type platform that does not require a lengthy stress-relieving sleeve.

BRIEF SUMMARY OF THE INVENTION

The present invention provides a riser support and tensioning apparatus and method and simplified keel joint that satisfies the aforementioned needs. According to one aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface and a plurality of non-linear springs associated with the table and the spar hull for permitting rotational movement between the table and the spar hull. The apparatus also comprises means for attaching the upper ends of the risers to the table.

According to another aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of elastomeric load pads are disposed between the table and the spar hull for permitting rotational movement therebetween. Larger capacity load pads are located near the center of the table for supporting the majority of the riser tension, and smaller capacity load pads are located near the perimeter of the table for controlling the rotational stiffness of the spar hull.

According to a still further aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of table supporting hydraulic cylinders is disposed between the table and the spar hull for permitting rotational movement therebetween. Each table supporting hydraulic cylinder has a first end pivotally attached to the table and a second end pivotally attached to the spar hull. At least one lateral support shaft has an upper end pivotally attached to the table and a lower end. For each lateral support shaft, at least one guide is attached to the spar hull for slidably receiving the lower end of the lateral support shaft.

According to another aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of pedestals is provided, each pedestal having a lower end attached to the spar hull and an upper end higher than the table for hanging the table therefrom. For each pedestal, at least one non-linear spring is associated with the table, the pedestal, and the spar hull for permitting rotational movement between the table and the spar hull.

According to still another aspect of the invention, for a spar type floating platform having risers passing vertically through the center well of a spar hull, apparatus is provided for suspending and tensioning a riser from a surface associated with the spar hull, and for permitting limited rotational movement between the riser and the surface. The apparatus comprises a hydraulic cylinder having one end attached to the riser and the other end attached to the surface. The tension in the riser may be adjusted by operation of the hydraulic cylinder. Means is provided for permitting rotational movement between the riser and the surface.

According to still another aspect of the invention, a method is provided for supporting a riser at a floating spar hull, the spar hull having a top surface. The method comprises the step of connecting a table to the spar hull, wherein the table has a limited range of rotational movement with respect to the spar hull top surface in response to environmental forces acting on the spar hull. The method further comprises the steps of suspending the riser from the table and of tensioning the riser.

With respect to the Continuation in Part application:

The present invention provides a keel joint for limiting bending stresses in the risers at the keel. The keel joint comprises an elongated guide attached to the keel of the spar hull. The guide has a vertical bore therethrough. A shaft is fitted within the bore of the guide. The shaft has a vertical bore therethrough for passage of one of the risers therethrough. A wear insert is associated with the shaft. The wear insert has an outer surface for slidingly engaging a portion of the keel joint.

The present invention also provides means for limiting yaw movement of the table. According to one aspect of the invention, the means for limiting yaw movement comprises a yaw control shaft extending horizontally from the table. At least one spherical bearing is attached to the yaw control shaft near its outer end. A pair of linear-spherical bushings is disposed on opposite sides of the yaw control shaft and mated to the spherical bearing for limited rotation thereon. Structure is associated with the spar hull forming a guide slot. The linear-spherical bushings are disposed within the guide slot for translational movement therein. Means is also provided for limiting surge and sway movements of the table with respect to the spar hull.

According to another aspect of the invention, the means for limiting yaw movement of the table comprises a first pair of collinear guide shoes extending from opposite sides of the first end of the table. A second pair of collinear guide shoes extend from opposite sides of the second end of the table. The collinear axes of the first and second pairs of guide shoes are laterally offset from the center of the table. A third and fourth pair of collinear guide shoes extend from opposite ends and opposite sides of the table. The collinear axes of the third and fourth pairs of guide shoes are positioned radially with respect to the center of the table. For each guide shoe, a respective bearing plate is attached to the spar hull. The guide shoe abuts the bearing plate.

BRIEF DESCRIPTION OF THE SEVERAL VIEWS OF THE DRAWING

For a more complete understanding of the invention, and the advantages thereof, reference is now mad to the following detailed description of the invention taken in conjunction with the accompanying drawings, in which.

DETAILED DESCRIPTION OF THE INVENTION

Figures 1, 4:
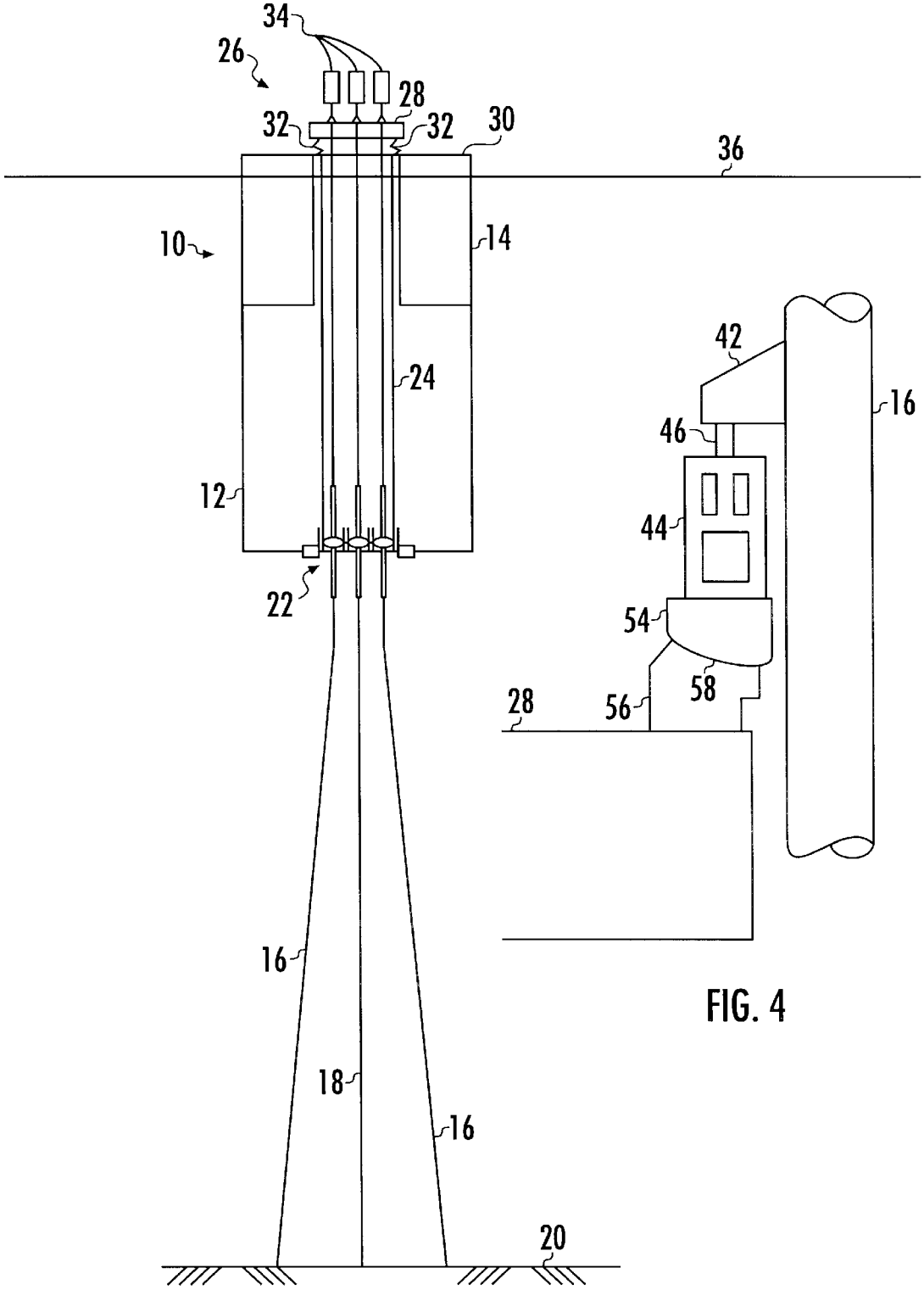
FIG. 1 is a schematic, side elevation view in cross-section of a spar type floating platform having a riser support apparatus of the present invention.
FIG. 4 illustrates an alternative, ball-in-socket device that may be used in the apparatus of FIG. 3.

Referring now to the drawings, and more particularly to FIG. 1, there is schematically shown a side elevation view of a spar type floating platform, generally designated 10, employing a riser support apparatus of the present invention. Spar platform 10 includes spar hull 12 having buoyancy tanks 14 at its upper end. Production risers 16 and drilling riser 18 extend from wells (not shown) on the sea floor 20 up through keel joint 22 at the lower end of spar hull 12. The risers 16 and 18 extend up through the center well 24 of spar hull 12 and are tied at their upper ends to riser support apparatus 26. Riser support apparatus 26 includes riser support table 28, which is compliantly supported above top surface 30 of spar hull 12 by non-linear springs 32. Trees 34 are attached to the upper ends of risers 16 and 18. Spar hull 12 floats at and extends slightly above water surface 36.

Figure 2:
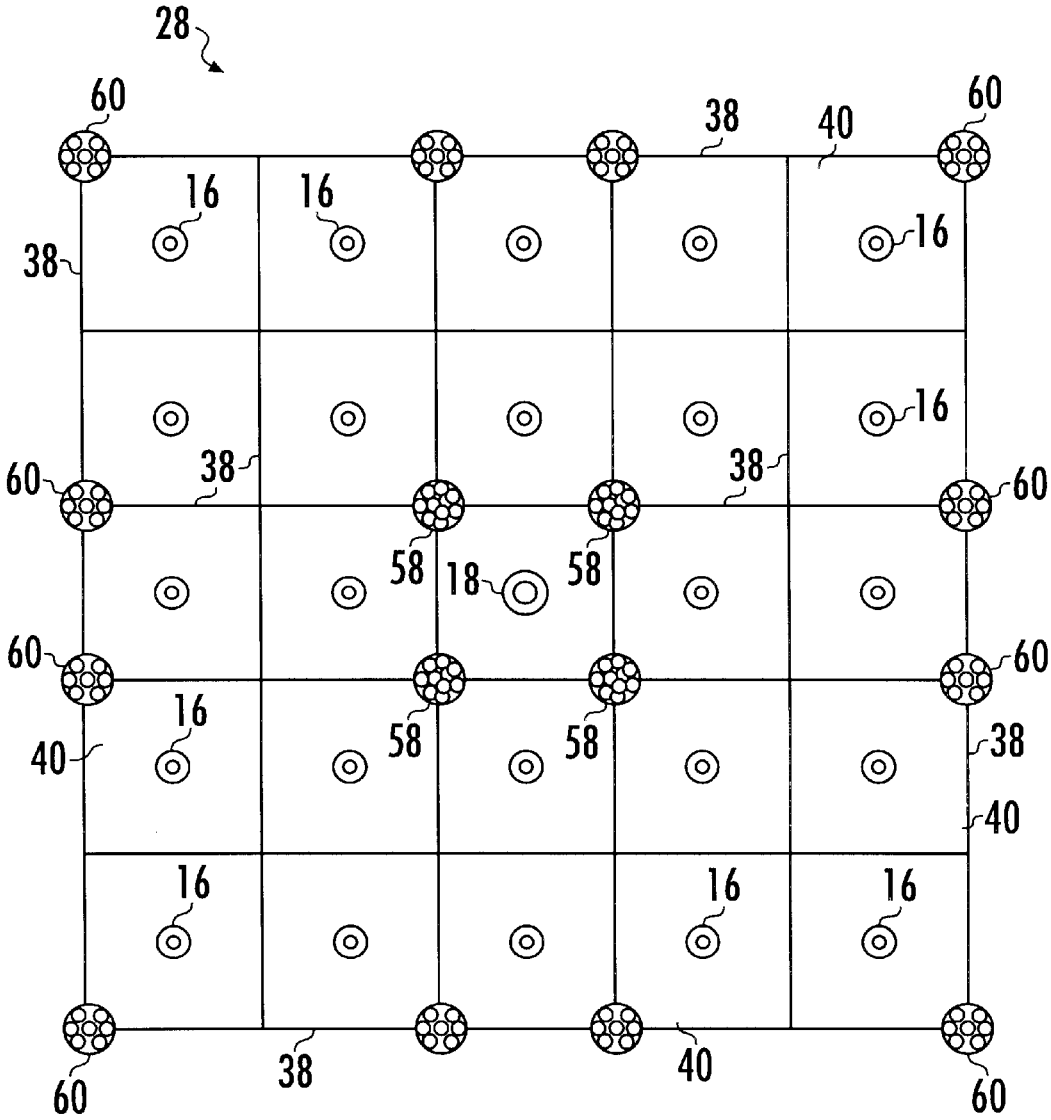
FIG. 2 is a plan view of the riser support table of the present invention.

Referring now to FIG. 2, there is shown a plan view of riser support table 28. Table 28 is made up of beams 38 interconnected to form a grid. Production risers 16 and drilling riser 18 pass through respective openings 40 of the grid of table 28.

Figure 3:
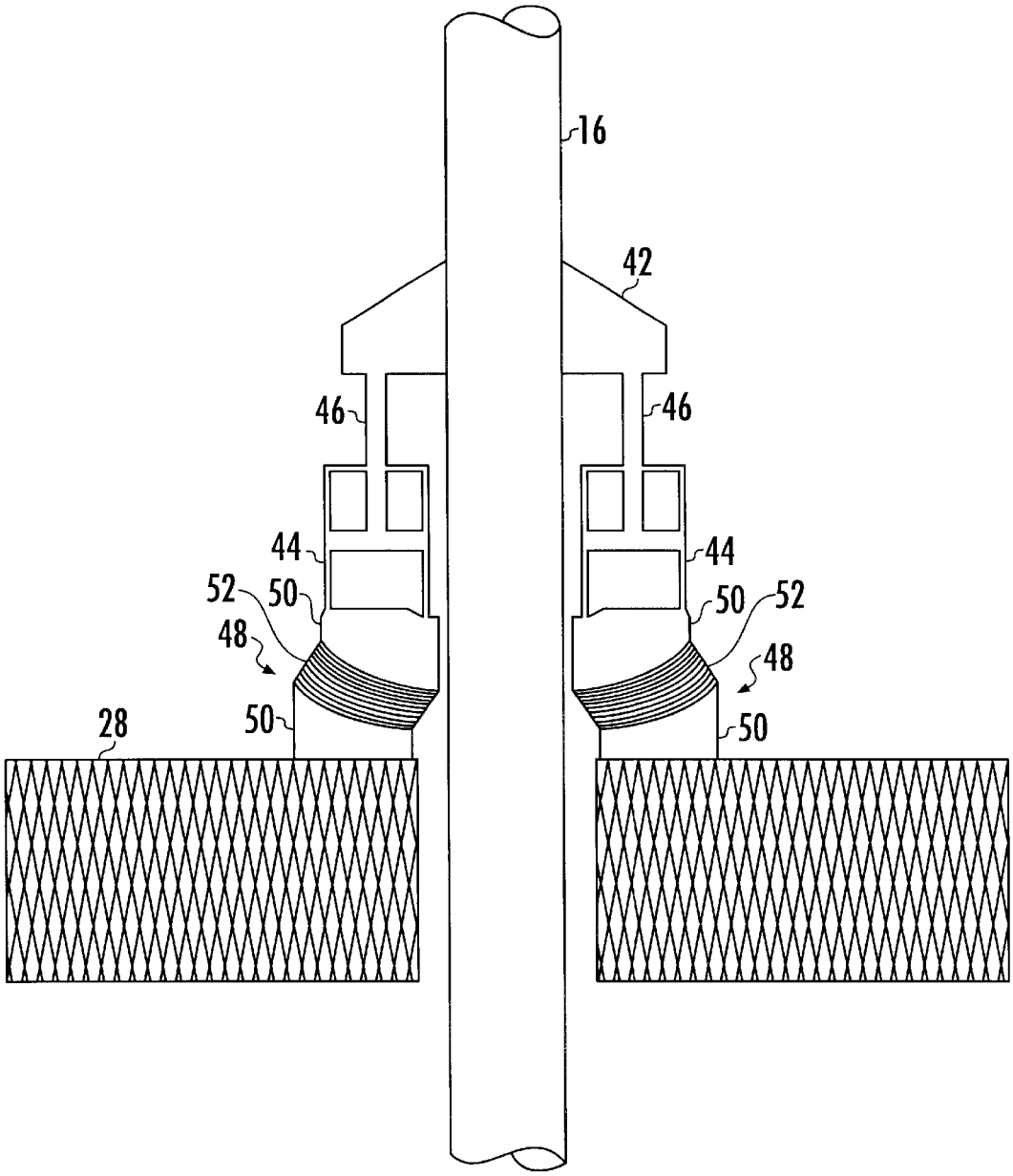
FIG. 3 is a side, cross-sectional view of an apparatus of the present invention for supporting and tensioning the risers.

FIG. 3 illustrates an apparatus of the present invention for supporting and tensioning risers 16 and 18 from riser support table 28. As seen in FIG. 3, riser support bracket 42 is clamped or welded to riser 16 above table 28. Riser tensioning hydraulic cylinders 44 located below riser support bracket 42 have pistons 46 attached to riser support bracket 42. The bottoms of hydraulic cylinders 44 are attached to table 28 by elastomeric flex units 48. Elastomeric flex units 48 permit relative rotation between hydraulic cylinders 44 and table 28, and thus between riser 16 and table 28. Some degree of rotation between risers 16 and 18 and table 28 is necessary because risers 16 and 18 will tend to remain parallel to the axis of spar hull 12, or tilt with spar hull 12, as table 28 rotates relative to spar hull 12. Elastomeric flex units include rigid portions 50 and flexible portions 52 between rigid portions 50. Rigid portions 50 are preferably made of steel, and flexible portions 52 are preferably made of an elastomeric material.

After risers 16 and 18 are installed on table 28, hydraulic cylinders 44 may be operated to adjust the tension and lengths of the risers to provide the correct fixed ballast to the spar hull from the riser weight, and to compensate for temperature changes in the risers caused by the produced fluid and the temperature of the surrounding risers.

FIG. 4 illustrates an alternative device to elastomeric flex units 48 for permitting relative rotation between hydraulic cylinders 44 and table 28. In this embodiment, a segment of a ball 54 is attached to the bottom of hydraulic cylinder 44, and a mating cup 56 is attached to table 28. Spherically shaped surface 58 of cup 56 slidingly engages the spherical surface of ball segment 54, and permits relative rotation between hydraulic cylinder 44 and table 28, and thus between riser 16 and table 28.

Figure 5:
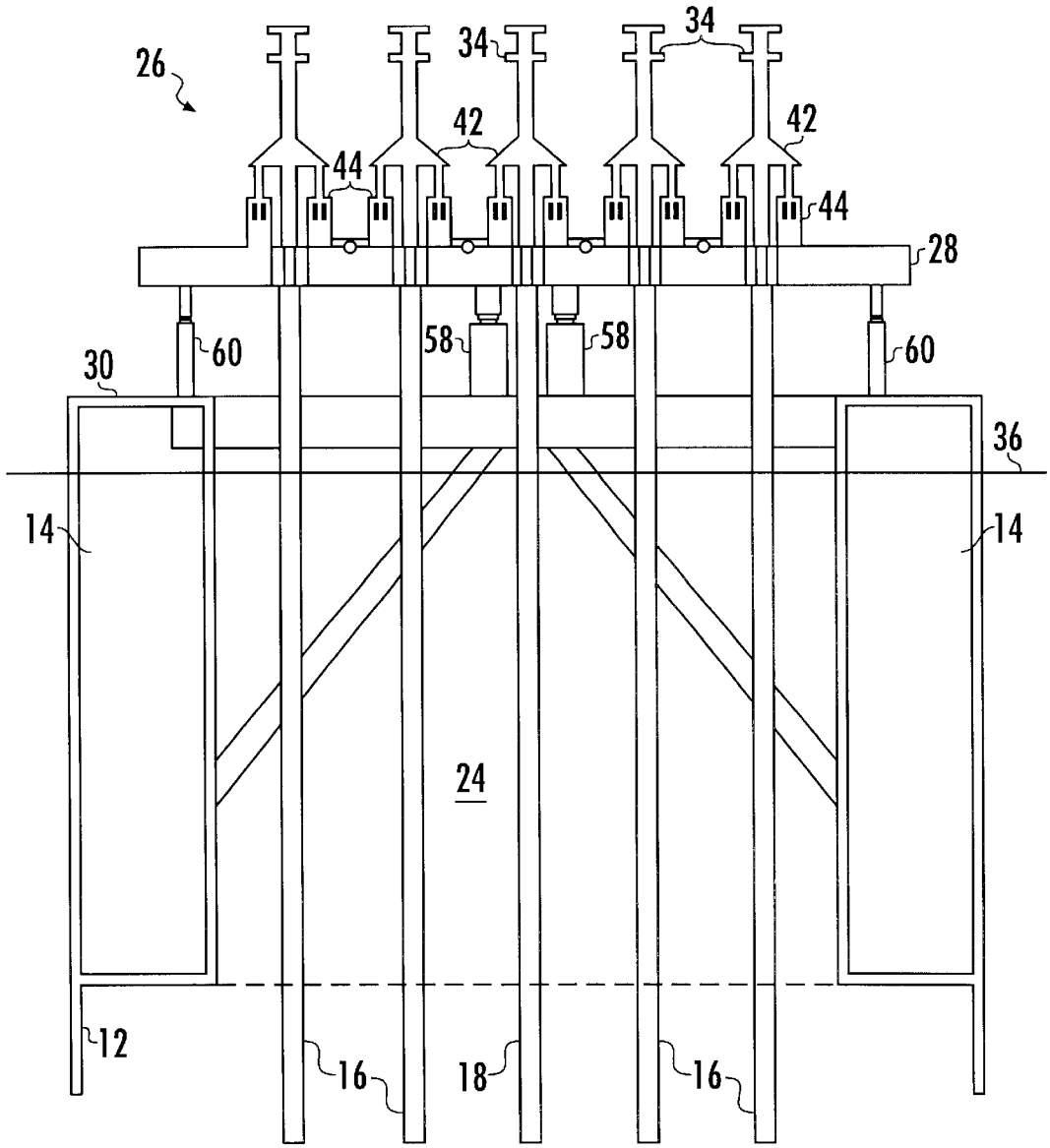
FIG. 5 is a schematic, side elevation view in cross-section of the upper portion of the spar hull and an embodiment of the riser support apparatus of the invention utilizing elastomeric load pads.

FIG. 5 illustrates a first embodiment of a riser support apparatus of the present invention. In this embodiment, elastomeric load pads 58 and 60 function as non-linear springs 32 for compliantly supporting table 28 above top surface 30 of spar hull 12, as described with reference to FIG. 1. Elastomeric load pads 58 and 60 are sized to be strong enough to support the tension in all of the risers 16 and 18 and with a spring rate that keeps the heave period of the spar platform and the riser support system larger than the dominant wave period. Elastomeric load pads 58 and 60 are placed laterally around table 28 in such a manner as to allow table 28 to rotate to a limited degree relative to spar hull top surface 30 as spar hull 12 pitches in response to environmental forces. This relative rotation is necessary to prevent large axial tension and compression fluctuations in risers 16 near the outer perimeter of table 28. Risers 16 are axially secured at their upper ends to table 28, and at their lower ends to the sea floor. Therefore, if table 28 were rigidly fixed in its position above spar hull top surface 30 without any means for relative rotation therebetween, a tilt of spar hull 12 from its normally vertical position would induce large compressive loads in the risers 16 on the side of spar hull 12 tilted down. This large compressive load would overstress and eventually buckle these risers. Similarly, the risers 16 on the opposite side of spar hull 12 would experience large tensile loads. The large variations in axial tension and compression in risers 16 would result in unacceptable fatigue damage to risers 16 over the lifetime of the installation. The relative rotation between table 28 and spar hull 12 permitted by elastomeric load pads 58 and 60 allows the upper ends of risers 16 to "float" with respect to upper surface 30 of spar hull 12, and thus prevents large axial tension and compression fluctuations in risers 16 resulting from environmentally induced pitching of spar hull 12.

As seen most clearly in FIG. 2, large capacity elastomeric load pads 58 are located near the center of table 28 for supporting a large portion of the riser tension. Smaller capacity elastomeric load pads 60 are located near the perimeter of table 28 for controlling the rotational stiffness of table 28 with respect to spar hull 12. The combined axial stiffness of all the risers 16 and 18 installed on the spar platform varies in direct proportion to the number of risers installed. When fewer risers are installed, their combined axial stiffness is reduced proportionately. Therefore, the vertical stiffness of the riser support apparatus does not normally require adjustment as risers 16 and 18 are added to, or removed from, table 28. Furthermore, regardless of the number of risers installed on table 28, the heave period of the spar platform and riser support system will be greater than the dominant wave period if the appropriate spring rate is chosen for elastomeric load pads 58 and 60.

As additional risers are suspended from table 28, the rotational stiffness of the riser support system may be increased by inserting additional smaller capacity elastomeric load pads 60 around the perimeter of table 28. Alternatively, variable stiffness elastomeric load pads may be used for load pads 60. These commercially available load pads have an interior, sealed air chamber that can be pressurized or depressurized as needed to adjust their stiffness.

Figure 6:
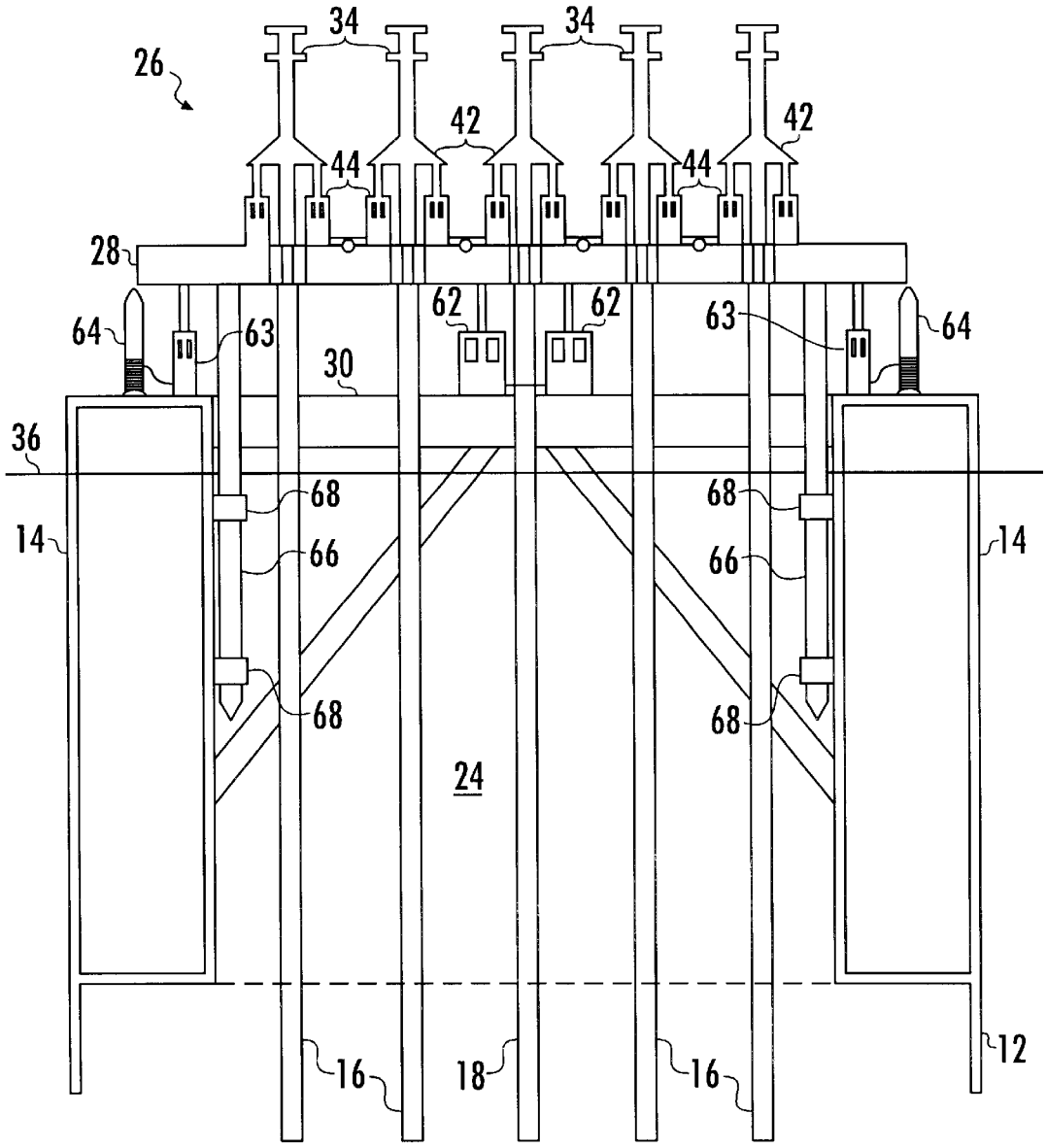
FIG. 6 is a schematic, side elevation view in cross-section of the upper portion of the spar hull illustrating an alternative embodiment of the invention utilizing table supporting hydraulic cylinders.

FIG. 6 illustrates an alternative embodiment of a riser support apparatus of the present invention. In this embodiment, table supporting hydraulic cylinders 62 and 63 function as non-linear springs 32 for compliantly supporting table 28 above top surface 30 of spar hull 12 as described with reference to FIG. 1. Large capacity hydraulic cylinders 62 are located near the center of table 28 for supporting a large portion of the riser tension. Smaller capacity hydraulic cylinders 63 are located near the perimeter of table 28 for controlling the rotational stiffness of table 28 with respect to spar hull 12. In order to permit table 28 to rotate about both horizontal axes with respect to spar hull 12, the upper ends of hydraulic cylinders 62 and 63 are pivotally attached to table 28, and the lower ends are pivotally attached to spar hull 12.

Air-over-oil accumulators 64 are hydraulically connected to smaller capacity hydraulic cylinders 63 for providing them with an adjustable spring rate. For a stiff spring rate, a relatively small amount of air should be maintained in accumulators 64. The use of hydraulic cylinders 63 with air-over-oil accumulators 64 provides greater operational flexibility than the riser support apparatus of FIG. 5. Both the tension force and the stiffness of hydraulic cylinders 63 can easily be adjusted over time by simply increasing or decreasing the air pressure in accumulators 64.

Because table supporting hydraulic cylinders 62 and 63 operate in compression and are hinged at their opposite ends, table 28 must be laterally supported with hydraulic cylinders 62 and 63 in their upright position to prevent table 28 and hydraulic cylinders 62 and 63 from folding down flat against upper surface 30 of spar hull 12. Lateral support shafts 66 provide the required lateral stability to the riser support apparatus of FIG. 6. The upper ends of lateral support shafts 66 are pivotally attached to table 28 so as to permit relative rotation between table 28 and spar hull 12. The lower ends of shafts 66 are loosely fitted within guides 68 attached to spar hull 12. Lateral support shafts 66 slide axially within guides 66 as table 28 tilts with respect to upper surface 30 of spar hull 12 in response to environmental loads. For a spar hull 12 having a center well 24 of square cross-sectional shape, four lateral support shafts 66 are preferably used, one being located near each of the four corners of center well 24.

Figure 7:
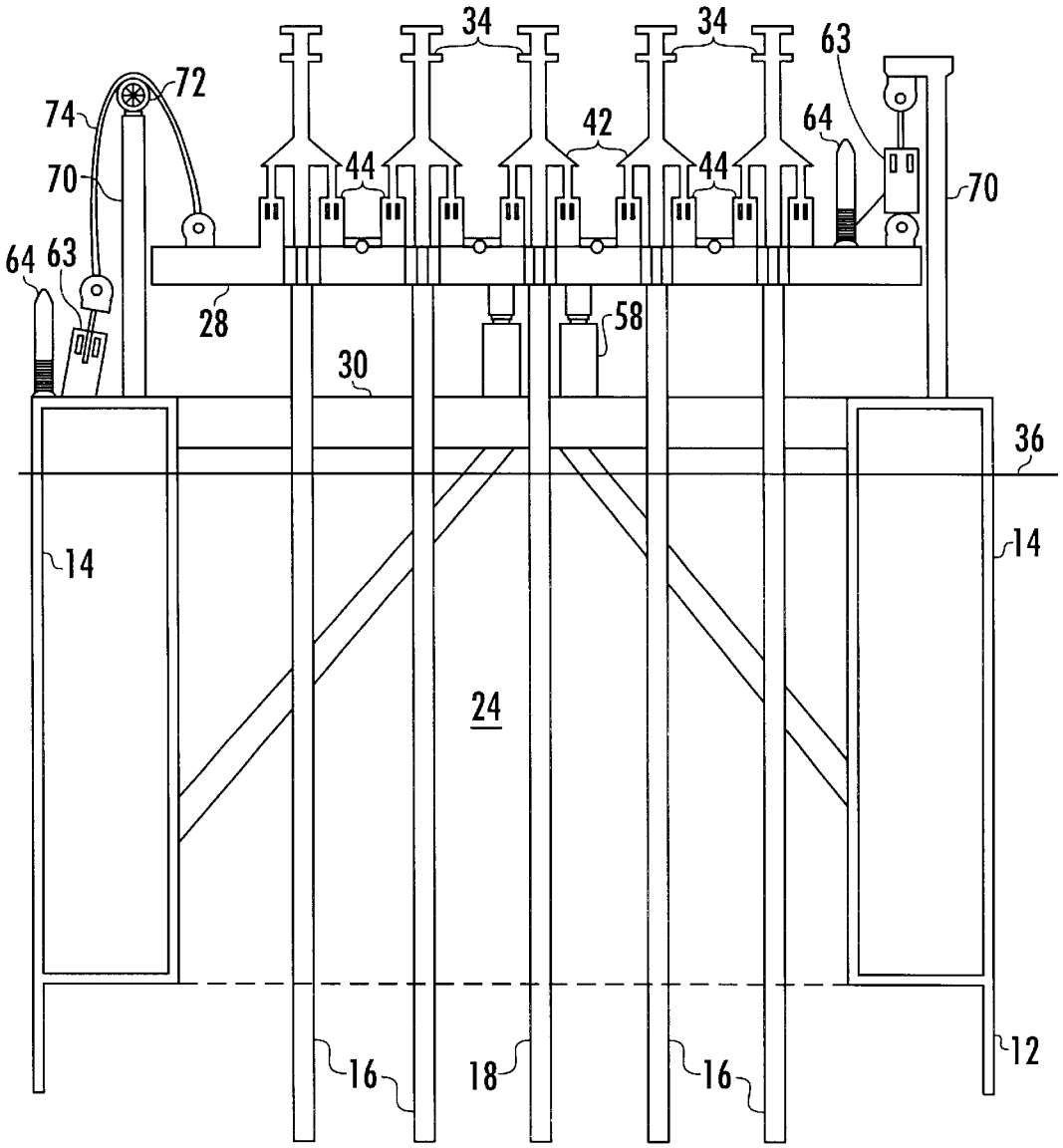
FIG. 7 is a schematic, side elevation view in cross-section of the upper portion of the spar hull illustrating an alternative embodiment of the invention wherein the riser support table is hanging from pedestals attached to the spar hull.

FIG. 7 illustrates another alternative embodiment of a riser support apparatus of the present invention. In this embodiment, table 28 is partially supported from the bottom only by elastomeric load cells 58 located near the center of table 28. To provide additional vertical support and the necessary lateral stability, table 28 is hung from pedestals 70. The lower ends of pedestals 70 are rigidly attached to spar hull 12, and their upper ends are higher than table 28 so that table 28 may be hung therefrom. Table supporting hydraulic cylinders 63 are used to provide limited rotational movement to table 28. With this arrangement, table 28 is naturally stable because it is suspended from an upper support structure.

FIG. 7 illustrates two ways in which table 28 may be hung from pedestals 70 by hydraulic cylinders 63. The first way is illustrated at the right end of table 28. Here, hydraulic cylinder 63 has an upper end pivotally connected to the top of pedestal 70 and a lower end pivotally connected to table 28, so that hydraulic cylinder 63 directly supports table 28 from pedestal 70. Air-over-oil accumulator 64 is placed on table 28 near, and is hydraulically connected to, hydraulic cylinder 63 to provide it an adjustable spring rate as described above with reference to hydraulic cylinders 63 in FIG. 6.

The second way in which table 28 may be hung from pedestals 70 is illustrated at the left end of table 28. Here, pulley 72 is pivotally mounted near the top of pedestal 70. Cable 74 passes over the top of pulley 72 and has one end attached to table 28 and the opposite end attached to the upper end of hydraulic cylinder 63. The lower end of hydraulic cylinder 63 is attached to spar hull 12 so that the tension in cable 74 is borne by hydraulic cylinder 63. Air-over-oil accumulator 64 is placed on spar hull 12 near, and hydraulically connected to, hydraulic cylinder 63 as described above. Although not illustrated, hydraulic cylinder 63 could instead be mounted on table 28 and connected to the opposite or right end of cable 74. In that case, the left end of cable 74 opposite hydraulic cylinder 63 would be connected directly to spar hull 12.

Figure 8:
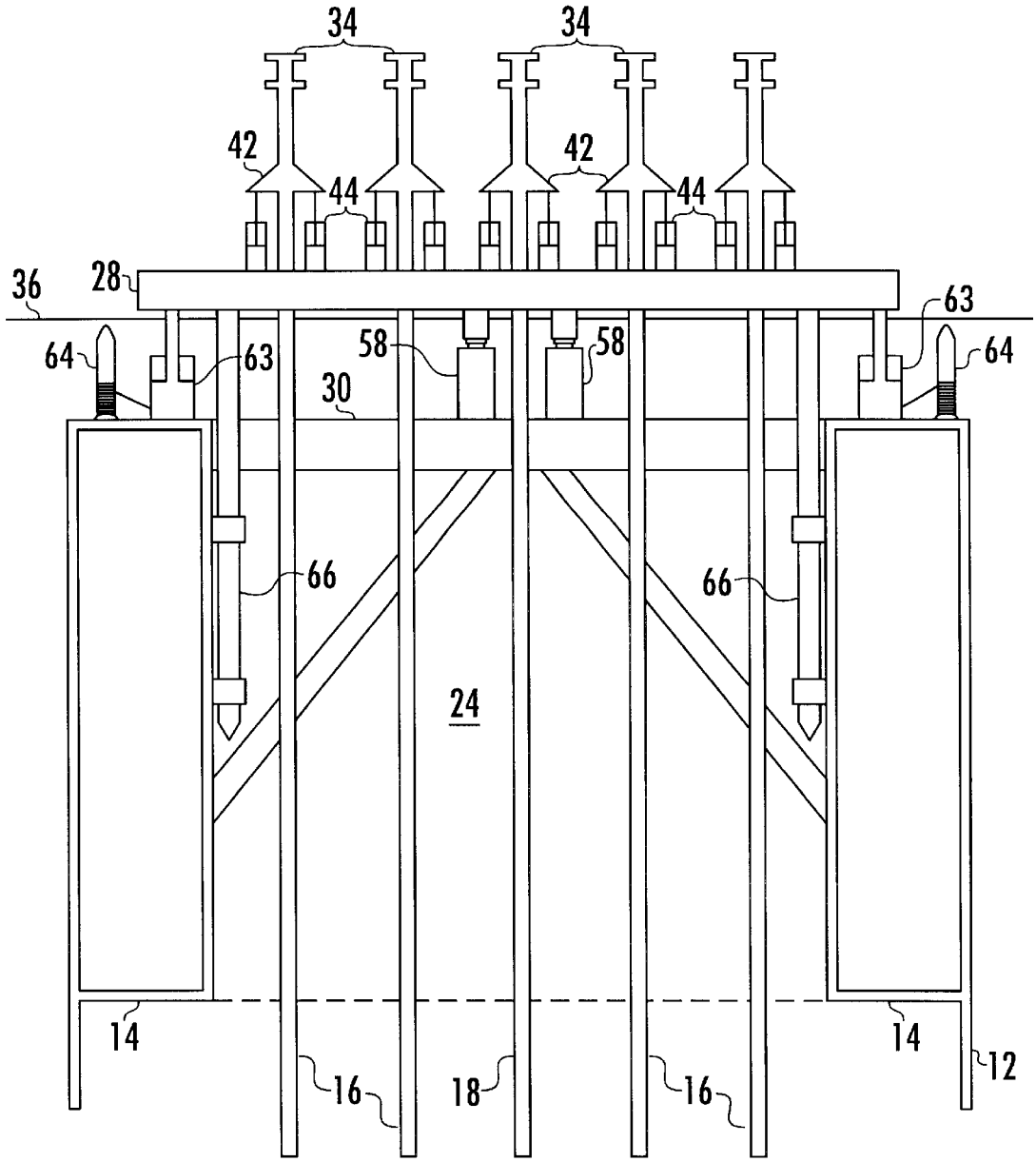
FIG. 8 illustrates an embodiment of the invention utilizing both elastomeric load pads and table supporting hydraulic cylinders.

FIG. 8 illustrates a combination of some of the above described alternative embodiments of the riser support apparatus of this invention. Such a combination of features may provide the most desirable system in terms of operational flexibility. Large, rather stiff elastomeric load pads 58 placed under and near the center of table 28 support the majority of the tension in risers 16 and 18. Four lateral support shafts 66 pivotally attached to table 28 and located near the corners of center well 24 of spar hull 12 provide the needed lateral stability to table 28. Smaller capacity table supporting hydraulic cylinders 63 located under and near the perimeter of table 28 provide the proper rotation stiffness. Depending on the direction of rotation of table 28, hydraulic cylinders 63 could act in either compression or tension. The tension and stiffness of hydraulic cylinders 63 can be adjusted by adjusting the air pressure in accumulators 64 to keep the overall rotational stiffness of table 28 at the desired level over time as wells are drilled and additional production risers 16 are installed.

A coupled computer aided design analysis was performed to compare a number of variable design parameters of a spar floating platform having a riser support system of the present invention with those of a traditional spar platform having risers individually supported by buoyancy cans. The analysis was based on the following fixed design parameters for both types of spar platforms:

| Design Basis | |
|---|---|
| Water depth: | 4500 feet |
| Topside weight: | 39,000 tons |
| Topside VCG above hull top: | 80 feet |
| Wind sail area: | 68,000 square feet |
| Wind center of pressure: | 150 feet |
| Number of wells: | 20 |
| Well pattern: | 5 × 5 |
| Production risers: | |
| outer casing outer diameter: | 13.375 inches |
| outer casing thickness: | 0.48 inches |
| inner casing outer diameter: | 10.75 inches |
| inner casing thickness: | 0.797 inches |
| tubing outer diameter: | 5.5 inches |
| tubing thickness: | 0.415 inches |
| Outer casing design pressure: | 4000 psi |
| Inner casing design pressure: | 8500 psi |
| Tubing design pressure: | 8500 psi |
| Fluid weights under production: | |
| Outer casing: | 8.55 ppg |
| Inner casing: | 15.5 ppg |
| Tubing: | 5.5 ppg |
| Riser tree elevation: | 55 feet |
| Total riser weight at tree elevation: | 872 kips |
| Riser weight at keel: | 736 kips |

-continued

| Design Basis | |
|---|---|
| Riser wet weight per foot: | 191 lb/ft. |
| Riser EA/L: | 325 kips/ft. |

The coupled design analysis resulted in the following design parameters for spar platforms having each type of riser support system:

| | Traditional spar with riser buoyancy cans | Spar with riser support system of invention |
|---|---|---|
| Spar center well | wet | wet |
| Center well size (feet) | 75 × 75 | 50 × 50 |
| Spar hull diameter (feet) | 158 | 150 |
| Draft (feet) | 650 | 650 |
| Hard tank depth (feet) | 255 | 245 |
| Freeboard (feet) | 55 | 55 |
| Truss height (feet) | 360 | 380 |
| Soft tank height (feet) | 35 | 25 |
| Hull steel weight (tons) | 29,937 | 29,200 |
| Fixed ballast (tons) | 36,668 | 21,844 |
| Riser tension supported (tons) | 0 | 14,160 |
| Variable ballast (tons) | 12,347 | 14,398 |
| Number of mooring lines | 16 | 16 |
| Mooring pattern | 4 × 4 | 4 × 4 |
| Pretension (kips) | 650 | 550 |
| Fairlead elevation (feet) | 255 | 245 |
| Upper chain | | |
| diameter (inches) | 5.875 | 5.875 |
| length (feet) | 250 | 250 |
| Wire | | |
| diameter (inches) | 5.375 | 5.125 |
| length (feet) | 6000 | 5500 |
| Lower chain | | |
| diameter (inches) | 5.875 | 5.875 |
| length (feet) | 200 | 200 |

There are several advantages attained by the use of the gimbaled table riser support system of the present invention with a spar type floating platform. First, the magnitude of spar pitch motions are reduced 10 to 25 percent from those of a traditionally designed spar with buoyancy cans. Second, because the gimbaled table supports the risers, the riser weight replaces fixed ballast in the spar hull. Therefore, the amount of fixed ballast required is greatly reduced by approximately 40 percent. Third, the need for buoyancy cans for supporting the risers is eliminated. This also eliminates released buoyancy can concerns and the need for buoyancy can guide structures. Fourth, riser pull-down relative to the spar hull is significantly reduced, which reduces jumper hose requirements. Fifth, a simplified keel joint design may be used. Sixth, the present invention permits easier drilling and production operations and easier access to trees and risers. Seventh, the riser tensioning system becomes more manageable and inspectable. Eighth, riser interference is essentially eliminated. Ninth, the spar hull diameter and center well size may be reduced. This in turn reduces the mooring line size requirement. Tenth, the smaller sea floor riser pattern reduces the amount of lateral offset of the spar platform. Eleventh, slip joint requirements are reduced, and requirements for drilling tensionsers and workover riser tensioning are eliminated. Twelfth, special workover buoyancy requirements are eliminated. Thirteenth, the smaller size center well permits reduced topside dimensions. Fourteenth, tensioning system redundancy is not required for each individual riser. Therefore, the need for an extra buoyancy chamber in each riser is eliminated. Finally, a riser support system of the present invention is less expensive to build, install, and maintain than the individual riser buoyancy can system in present use.

With respect to the Continuation in Part application, the simplified keel joint of the present invention is designed for use with surface supported vertical risers (SSVR) on a spar type floating production platform. The purpose of the keel joint is to limit the bending moment in the riser at the location where the riser enters the center well of the hull at the keel. As the floating platform moves in response to environmental conditions, the risers contact the hull bottom due to the lateral offset of the hull relative to the fixed location of the risers on the seabed. This lateral offset also induces relative vertical movement between the hull and the risers. Additional relative movement between the risers and the hull is generated due to the heave response of the vessel. This relative movement between the risers and the platform hull may cause contact wear that would be detrimental over the life of the system.

The simplified keel joint consists mainly in a guide attached to the keel of the spar hull, a single ball joint and, in some embodiments, a sleeve for contact wear. The keel joint segregates the functions of rotation of the risers within the keel in response to bending moments on the risers and wear in response to relative motion between the risers and the hull. This configuration allows the uses of specific materials to minimize wear and galling at the ball joint and of standard vessel construction materials for the sleeve, in which a certain amount of wear can be designed for and tolerated.

Figure 9:
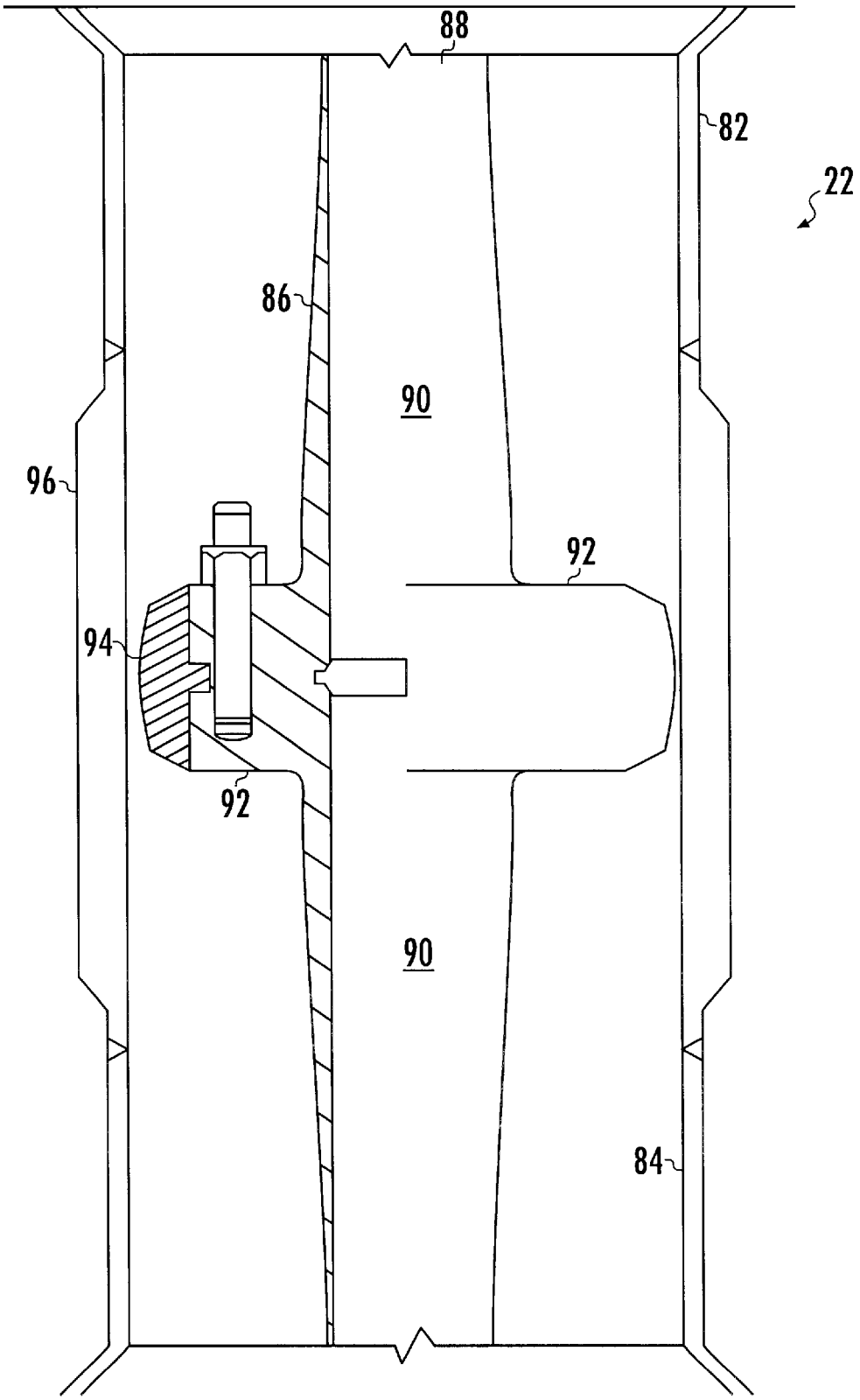
FIG. 9 is a view, taken along the longitudinal center line and partially in cross-section, of a first embodiment of a simplified keel joint of the present invention that uses no sleeve.

FIG. 9 is a view, taken along the longitudinal center line and partially in cross-section, of a simplified keel joint 22 of the present invention. Keel joint 22 includes elongated guide 82 attached to the keel of the spar hull (not illustrated). Keel joint 22 also includes shaft 86 contained within the vertical bore 84 of guide 82. Shaft 86 is made up of a pair of tapered pipe sections 90 having flanges 92 on one end. Flanges 92 are joined together end-to-end. A riser (not illustrated) passes through vertical bore 88 in shaft 86.

Ball wear insert 94 is attached to the outer circumferential surface of flanges 92. Ball wear insert 94 has an outer surface for slidingly engaging a portion of the keel joint 22. The convex outer shape of ball wear insert 94 permits a small degree of rotation of shaft 86 within guide 82. Ball wear insert 94 also absorbs contact wear with guide 82. In this embodiment, the ball joint comprises flanges 92, their ball wear insert 94, and the central portion 96 of guide 82. In one embodiment, the diameter of bore 84 in guide 82 is 50 inches±¼ inches, and the outer diameter of ball wear insert 94 is 48 inches±1/16 inches.

Ball wear insert 94 slidingly engages a central portion of elongated guide 82. The central portion of guide 82 engaged by wear insert 94 has a thickened wall with respect to the wall thickness of the remainder of the guide 82 for withstanding stress imposed thereon by wear insert 94. The length of central portion 96 corresponds to the normal stroke of the riser within keel joint 22. The length of guide 82 corresponds to the expected extreme stroke of the riser. Guide 82 is designed for contact wear with ball wear insert 94.

Figure 10:
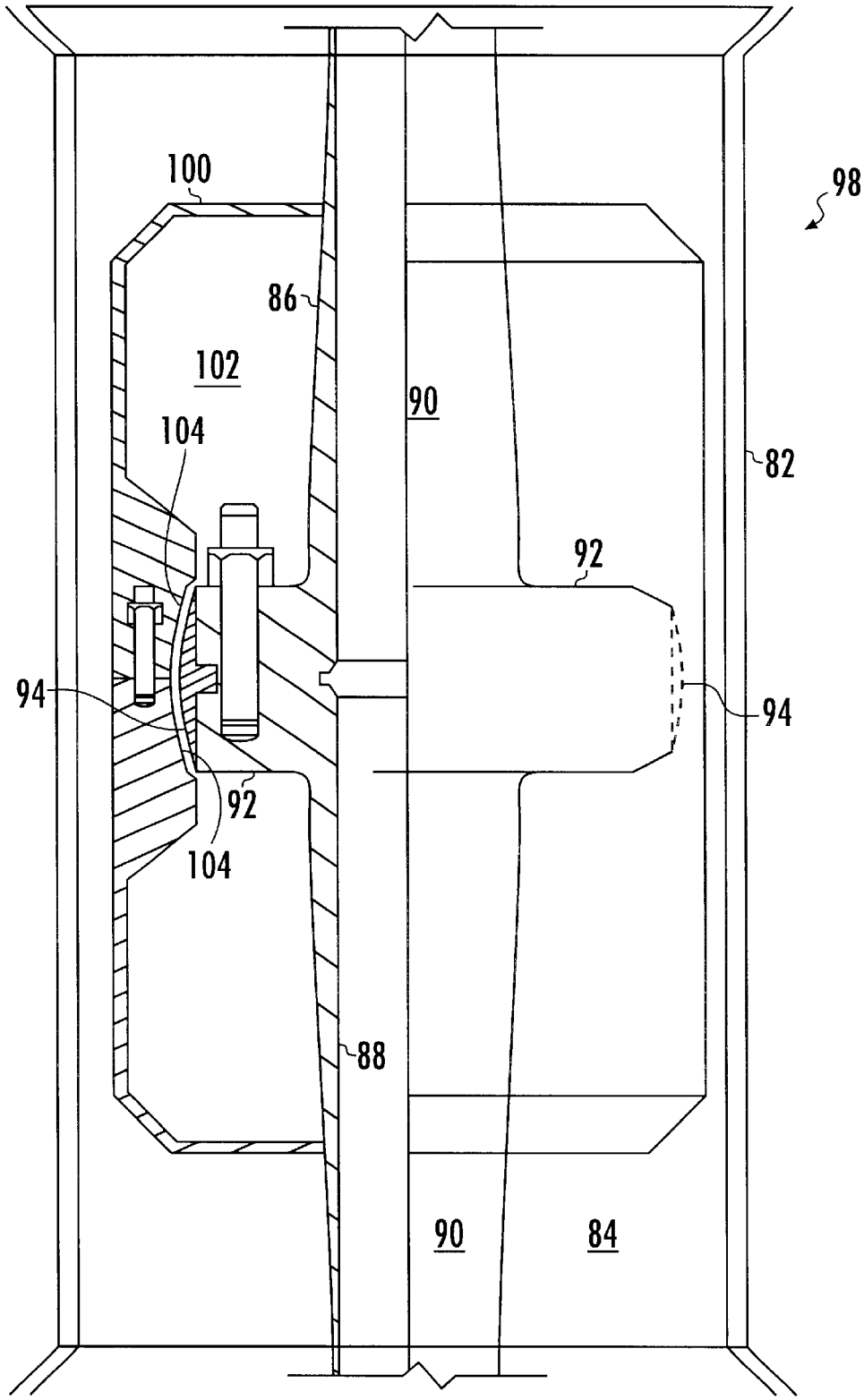
FIG. 10 is a view, taken along the longitudinal center line and partially in cross-section, of a second embodiment of a keel joint of the invention having a sleeve fitted around the wear insert.

FIG. 10 is a view, taken along the longitudinal center line and partially in cross-section, of a second embodiment of a keel joint 98 of the invention. Keel joint 98 includes a sleeve 100 fitted within the bore 84 of the guide 82 and slidable therein. Sleeve 100 has a central opening 102 therein containing wear insert 94 and at least a portion of shaft 86. Sleeve 100 has an inner surface 104 slidingly mating to wear insert 94 for permitting rotation of the riser and shaft 86 with respect to sleeve 100 and guide 82.

In the illustrated embodiment, wear insert 94 comprises a ball wear insert and the mating sleeve surface 104 is concave for conforming to the ball wear insert 94 shape. Sleeve 100 resists contact load between shaft 86 and guide 82. Sleeve 100 is also designed for contact wear with ball wear insert 94. In one embodiment, the diameter of bore 84 in guide 82 is 50 inches±¼ inch, and the outer diameter of sleeve 100 is 48 inches±¼ inch.

Figure 11:
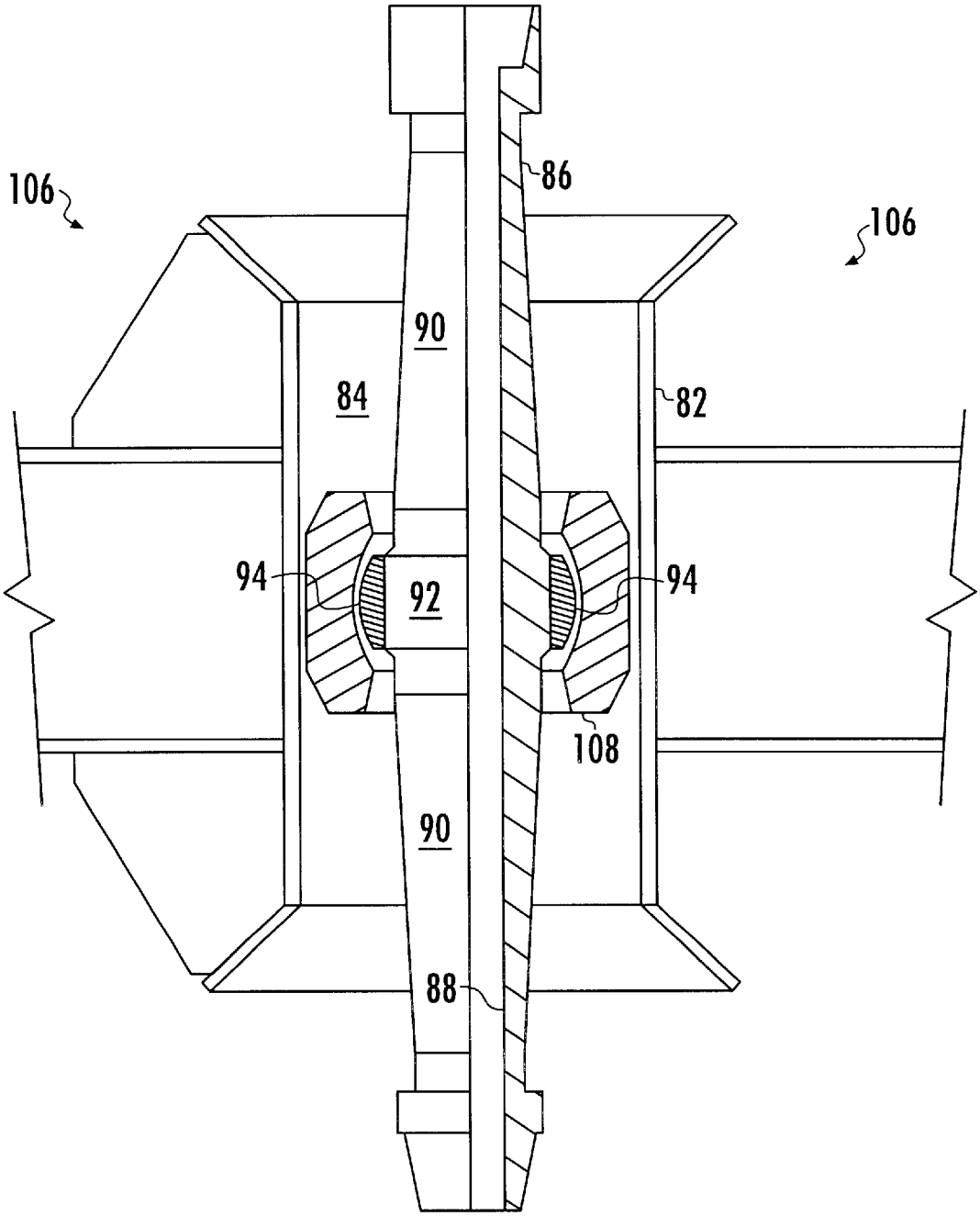
FIG. 11 is a view, taken along the longitudinal center line and partially in cross-section, of a third embodiment of a keel joint of the invention having a more compact sleeve fitted around the wear insert.

FIG. 11 is a view, taken along the longitudinal center line and partially in cross-section, of a third embodiment of a keel joint 106 of the invention. Keel joint 106 is similar in many respects to keel joint 98 of FIG. 10. However, keel joint 106 has a more compact sleeve 108 that fits closely around flanges 92 of pipe sections 90. Sleeve 108 resists contact load between shaft 86 and guide 82 and is designed for contact wear with ball wear insert 94. In one embodiment, a 1 inch nominal gap is provided between the outer surface of sleeve 108 and the bore wall of guide 82.

The invention also includes apparatuses 109 and 132 for limiting yaw movements of riser support table 28. The gimballing system establishes a center of rotation for the table about which it is allowed to roll and pitch (tilting movement of the spar) freely. This center of rotation is also allowed to translate axially (heave movement of the spar) freely. That is, the table is allowed three degrees of freedom relative to the spar hull: roll, pitch, and heave. Of the remaining three degrees of freedom, two of them, the relative lateral translations (surge and sway) are eliminated except for minor gaps and elastic deformations. The remaining degree of freedom (yaw) is eliminated by the yaw limiting device. The table gimballing system controls secondarily induced yaw movement of the table within acceptable limits. The secondarily induced yaw is a function of the table tilt angle and its orientation with respect to the principal axes of the table.

Figure 12:
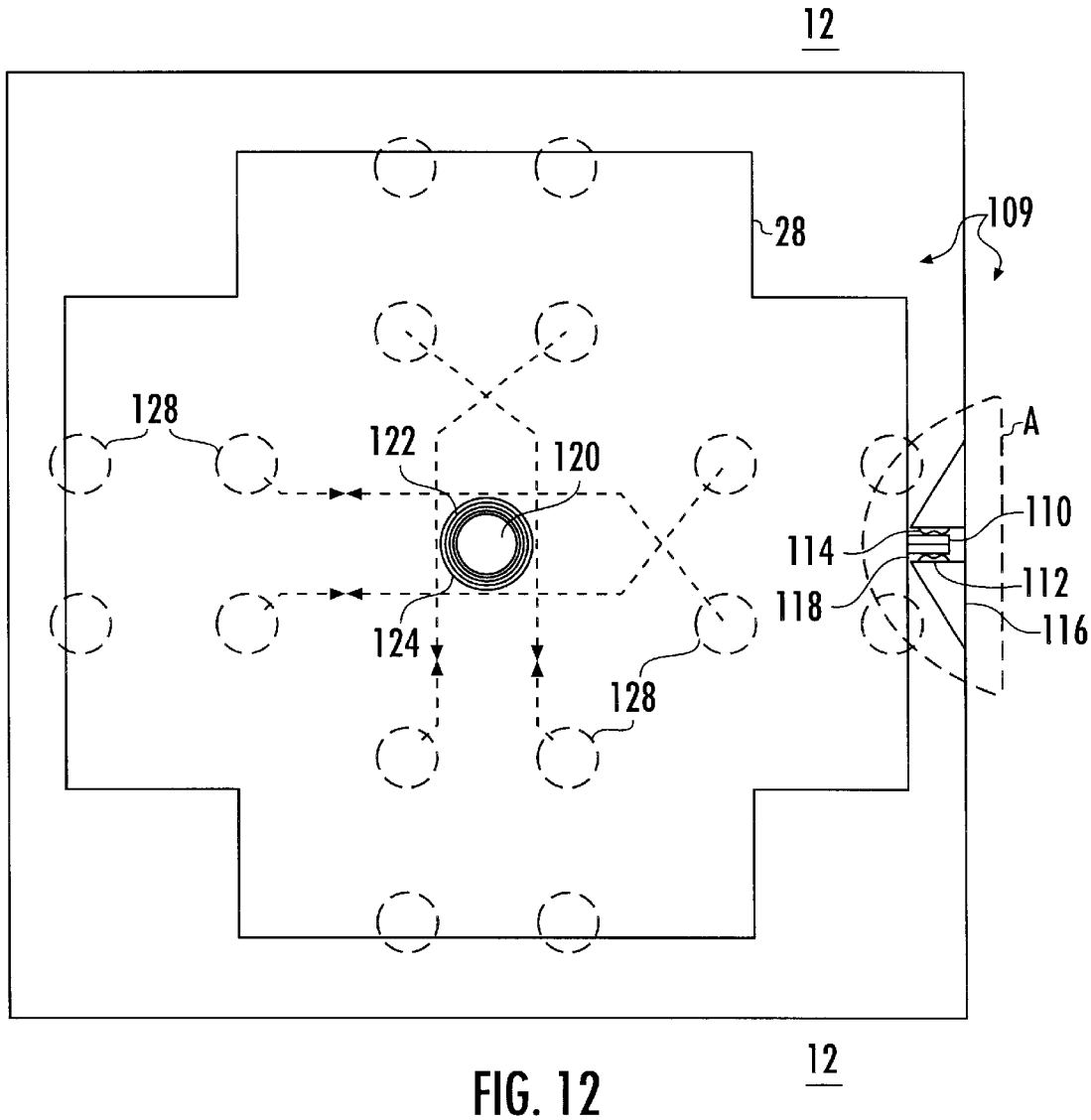
FIG. 12 is a plan view of a riser support table equipped with a first embodiment of a yaw limiting apparatus of the invention having a kingpost.
Figure 13:
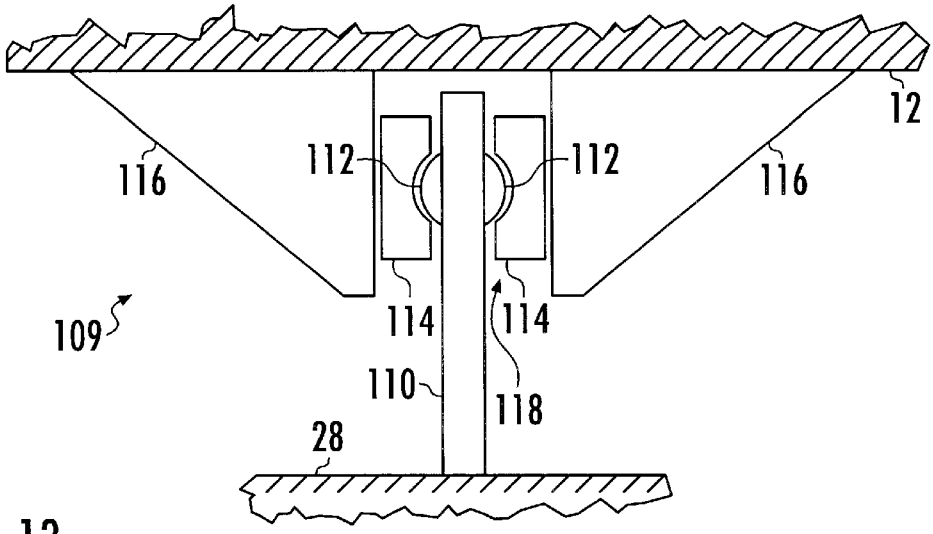
FIG. 13 is an enlarged view of the encircled portion denoted "A" in FIG. 12.
Figure 14:
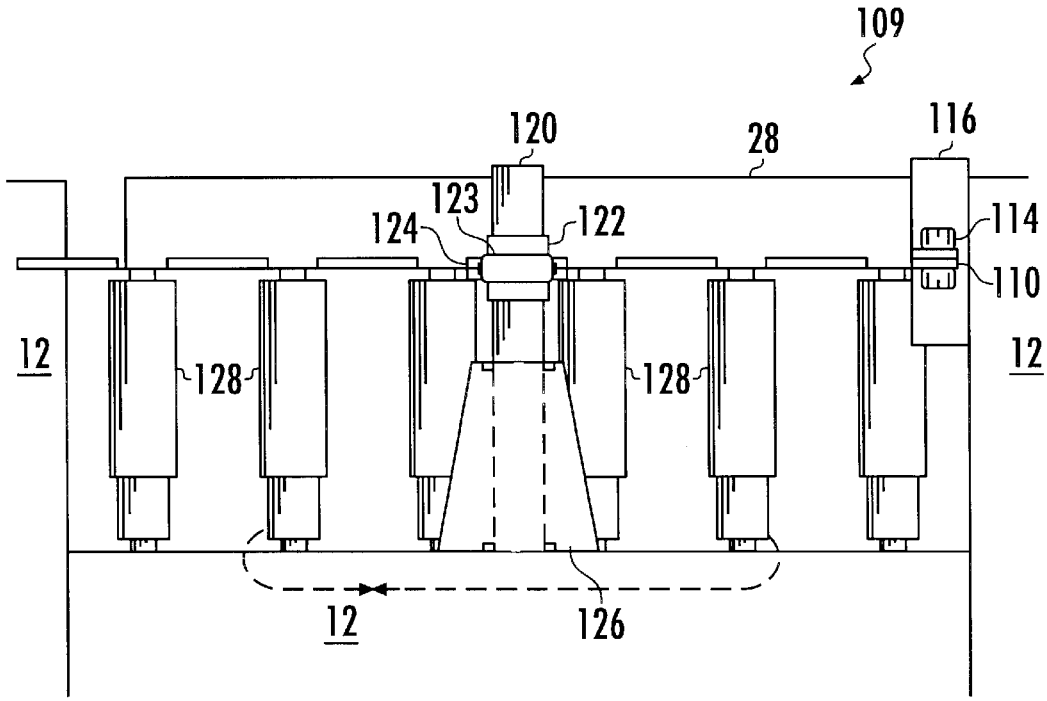
FIG. 14 is an elevation view, taken along the centerline and partially in cross-section, of the riser support table and yaw limiting apparatus of FIG. 12.

FIGS. 12–14 illustrate yaw limiting apparatus 109 of the present invention. FIG. 13 is an enlarged view of the encircled portion denoted "A" in FIG. 12. Apparatus 109 includes a yaw control shaft 110 extending horizontally out from the table 28. As best seen in FIG. 13, a pair of spherical bearings 112 are attached on opposite sides of yaw control shaft 110 near its outer end. A pair of linear-spherical bushings 114 are mated to respective spherical bearings 112 for limited rotation thereon. Linear-spherical bushings 114 have flat sides opposite spherical bearings 112 that slide against respective guide slot members 116. Guide slot members 116 are fixed in position with respect to spar hull 12, and together form guide slot 118. Linear-spherical bushings 114 are disposed within guide slot 118 for translational movement therein.

Means is also provided for limiting surge and sway movements of riser support table 28 with respect to spar hull 12. Referring to FIG. 14, kingpost shaft 120 has a lower end supported from spar hull 12 and an upper end near the center of table 28. Kingpost shaft 120 is positioned coaxially with the central, longitudinal axis of spar hull center well 24. Kingpost shaft 120 is supported from spar hull 12 by a base pedestal 126. Pedestal 126 is secured to spar hull 12 or to a support structure for table 28.

A linear-spherical inner bearing 122 slides axially along kingpost shaft 120, and includes a spherical center portion 123. A spherical outer bushing 124 is attached within an opening in riser support table 28, and has a spherical inner surface that is mated to linear-spherical inner bearing 122. The rotation of linear-spherical inner bearing 122 within spherical outer bushing 124 permits riser support table 28 to heave, pitch, and roll with respect to spar hull 12. In the illustrated embodiment, support cylinders 128 function as non-linear springs 32. Support cylinders 128 may be pneumatic or hydraulic in various embodiments of the invention.

As seen in FIGS. 12–14, yaw limiting apparatus 109 offers no resistance to heave, roll, pitch, surge, or sway of riser support table 28 with respect to spar hull 12. However, apparatus 109 does prevent yaw movement of table 28 about its vertical center line through the torque arm between kingpost 120 and spherical bearings 112 on shaft 110. It should be noted that yaw limiting apparatus 109 employs conventional bearings that have either flat, cylindrical, or spherical bearing surfaces that slide against similarly shaped surfaces of mating bushings. Therefore, the bearing areas are essentially independent of the bearing loads. Further, the bearing surfaces may be greased to improve their bearing characteristics. The bearings may also be enclosed to retain the lubricant and for protection from environmental, contaminate, or mechanical damage. Additionally, the bearings have inherently self-wiping edges that act as excluders of mechanical debris and contaminates. This is particularly beneficial for the spherical bearings 112 and linear-spherical bushings 114 that would be difficult to enclose.

One of the primary advantages of yaw limiting apparatus 109 is that it uses conventional bearings that can be made in a machine shop to conventional tolerances. These are essentially unitized bearings that can be factory assembled and function tested before shipping. Further, they do not require sophisticated field assembly fit up that would be required of unconventional bearings.

Another advantage of yaw limiting apparatus 109 is that all of the primary lateral table loads are taken out through base pedestal 126 directly down into the table support structure. Therefore, the table support structure may be raised up flush with the spar deck and the primary lateral table loads are transferred out into the spar at the spar deck level. The secondary anti-yaw lateral loads are transferred out into the spar at the cellar deck level. This elevates the entire assembly of support cylinders up out of the center well and positions the support cylinders on the spar deck level where there would be good access to them for installation, inspection, maintenance, repair, and/or change-out. This also places the support cylinders in an environment that is inherently well ventilated.

Figure 15:
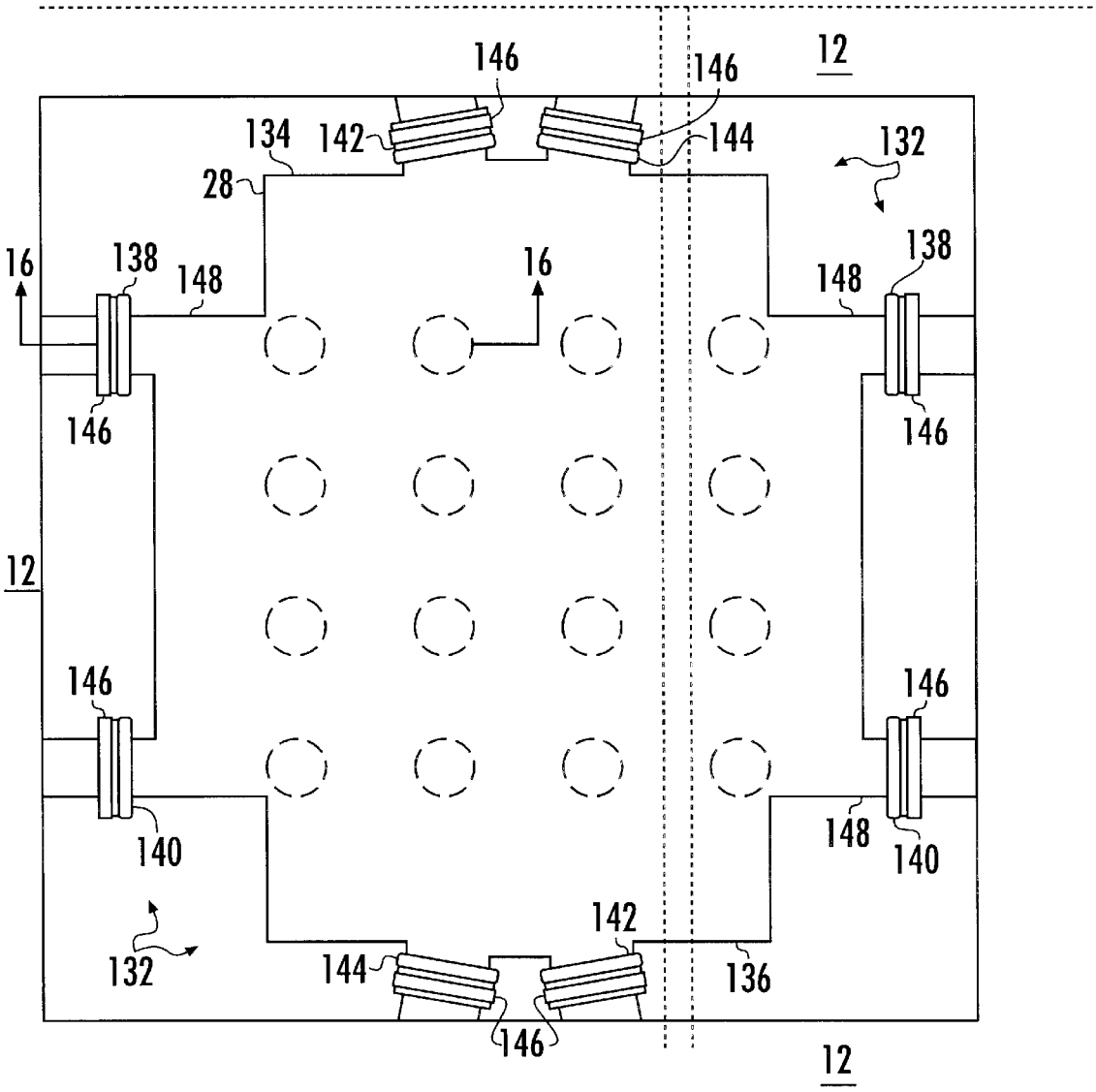
FIG. 15 is a plan view of a riser support table equipped with a second embodiment of a yaw limiting apparatus of the invention having a plurality of guide shoes.
Figure 16:
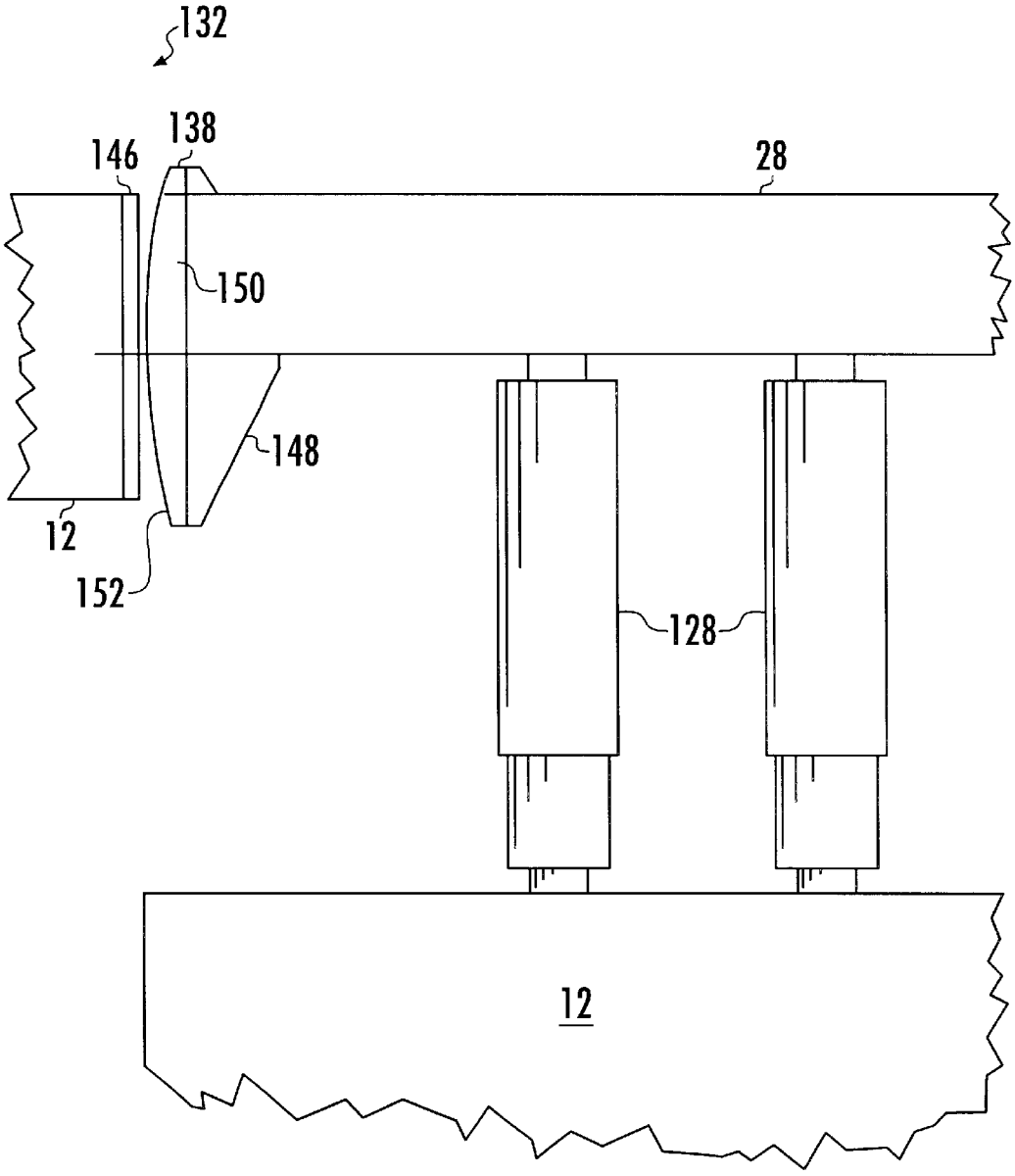
FIG. 16 is an elevation view, taken along the centerline and partially in cross-section, of one side of the riser support table and yaw limiting apparatus of FIG. 15.

FIGS. 15–16 illustrate a riser support table 28 utilizing yaw limiting apparatus 132 according to a second embodiment of the present invention. FIG. 15 is a plan view of table 28 equipped with yaw limiting apparatus 132. FIG. 16 is a partial elevation view taken along line 16—16 in FIG. 15. The portion of table 28 omitted from FIG. 15 is identical to that shown. Table 28 has first end 134 and second end 136. A first pair of collinear guide shoes 138 extend from opposite sides of the first end 134 of table 28. A second pair of collinear guide shoes 140 extend from opposite sides of the second end 136 of table 28. As seen in FIG. 15, the collinear axes of the first pair 138 and second pair 140 of guide shoes is laterally offset an equal distance from the center of table 28.

A third pair of collinear guide shoes 142 extend from opposite ends 134 and 136 and from opposite sides of table 28. A fourth pair of collinear guide shoes 144 extend from opposite ends 134 and 136 and from opposite sides of table 28. The collinear axes of the third pair 142 and the fourth pair 144 of guide shoes is positioned radially from the center of table 28.

As best seen in FIG. 16, each guide shoe 138, 140, 142, and 144 abuts a respective bearing plate 146 attached to spar hull 12. Bearing plates 146 comprise low friction material. Examples of such low friction material include molybdenum disulfide filled PTFE and carbon-graphite filled PTFE.

Each guide shoe 138, 140, 142, and 144 comprises a base 148 attached to table 28. Elastomeric cushion 150 is attached to the outer surface of base 148. A slide plate 152 overlies each elastomeric cushion 150. Each slide plate 152 forms a segment of a horizontal circular cylinder in geometric shape.

Guide shoe pairs 138 and 140 located on the two opposite sides of table 28 are positioned orthogonally with respect to the center of table 28 so that they form segments of an imaginary horizontal circular cylinder enveloping these two sides of table 28. Guide shoes 138 and 140 slide horizontally and vertically between two parallel, prismatic vertical walls formed by respective bearing plates 146 so as to resist surge and yaw movements of table 28. Guide shoes 142 and 144 located on ends 134 and 136, respectively, of table 28 are positioned radially with respect to the center of table 28 so that they form segments or portions of an imaginary sphere enveloping the orthogonal pair of sides of table 28. Guide shoes 142 and 144 slide within vertical circular cylindrical walls formed by respective bearing plates 146 so as to resist primarily sway movements of table 28, but not yaw movements. Therefore, yaw limiting apparatus 132 provides no over-constraint on yaw movements. Hence, there is no requirement for the guide shoes to have radial offsets and/or excessive compliance. Table 28 is securely guided through secondarily induced yaw angular movements by apparatus 132 almost as precisely as by yaw limiting apparatus 109 having the kingpost configuration (described above).

Figure 17:
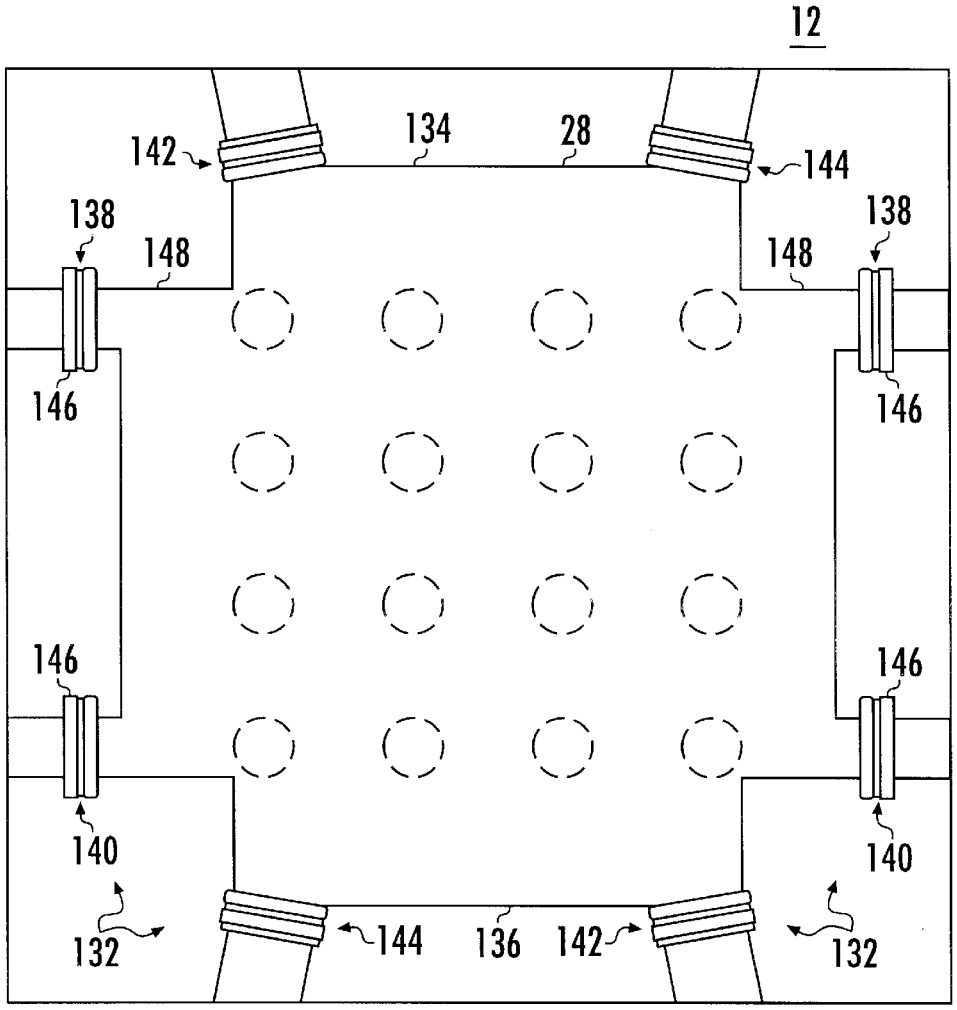
FIG. 17 is a plan view of a riser support table equipped with a third embodiment of a yaw limiting apparatus of the invention.

FIG. 17 is a plan view of a riser support table 28 equipped with a third embodiment of a yaw limiting apparatus of the invention in which guide shoes 142 and 146 on each end of table 28 are spaced farther apart than in the embodiment illustrated in FIG. 15.

The gimbaled table riser support system and method of the present invention, and many of its intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the form hereinbefore described being merely exemplary embodiments thereof.

What is claimed is:

1. A keel joint apparatus for a spar-type floating platform having risers passing vertically through a center well of a spar hull, the spar hull including a keel at the lower end of the center well and the risers passing through the keel, wherein the keel joint apparatus limits bending stresses in the risers at the keel, the keel joint apparatus comprising:

an elongated guide attached to the keel and having a first vertical bore therethrough;

a shaft disposed within the first vertical bore and having a second vertical bore for passage of a riser therethrough; and a wear insert associated with the shaft so as to slidingly engage a portion of the guide, wherein the wear insert comprises a ball insert that permits rotation of the riser and the shaft with respect to the guide.

2. The apparatus of claim 1, further including a sleeve fitted within the bore of the guide and slidable therein, the sleeve having a central opening therein containing the wear insert and at least a portion of the shaft, the sleeve having a surface slidingly mating to the wear insert for permitting rotation of the riser and shaft with respect to the sleeve.

3. The apparatus of claim 2, wherein the wear insert comprises a ball insert and the mating sleeve surface is concave for conforming to the ball insert shape.

4. The apparatus of claim 1, wherein the shaft comprises a pair of pipe sections, each section having a flange on one end thereof, the flanges being joined together end-to-end.

5. The apparatus of claim 4, wherein the outer surfaces of the pipe sections are tapered.

6. The apparatus of claim 4, wherein the wear insert is attached to the outer circumferential surfaces of the flanges on the pipe sections.

7. The apparatus of claim 1, the wear insert slidingly engaging a central portion of the elongated guide, and wherein the central portion of the guide engaged by the wear insert has a thickened wall with respect to the wall thickness of the remainder of the elongated guide for withstanding stress imposed thereon by the wear insert.

8. For a spar type floating platform having risers passing vertically through the center well of a spar hull, the spar hull having a top surface, apparatus for supporting the risers from the spar hull, which comprises:

a table disposed above the spar hull top surface;

a plurality of non-linear springs associated with the table and the spar hull for permitting rotational movement between the table and the spar hull;

means for attaching the upper ends of the risers to the table; and means for limiting yaw movement of the table.

9. The apparatus of claim 8, wherein the means for limiting yaw movement of the table comprises:

a yaw control shaft extending horizontally from the table;

at least one spherical bearing attached to the yaw control shaft near its outer end;

a pair of linear-spherical bushings disposed on opposite sides of the yaw control shaft and mated to the spherical bearing for limited rotation thereon;

structure associated with the spar hull forming a guide slot, the linear-spherical bushings being disposed within the guide slot for translational movement therein; and means for limiting surge and sway movements of the table with respect to the spar hull.

10. The apparatus of claim 9, wherein the means for limiting surge and sway movements of the table with respect to the spar hull comprises:

a kingpost shaft having a lower end supported from the spar hull and an upper end near the center of the table;

a linear-spherical inner bearing mounted on the kingpost and axially slidable thereon;

a spherical outer bushing associated with the table and mated to the linear-spherical inner bearing, whereby the table is permitted freedom of motion in heave, pitch, and roll with respect to the spar hull.

11. The apparatus of claim 10, wherein the kingpost shaft is supported from the spar hull by a base pedestal secured to the top surface of the spar hull.

12. The apparatus of claim 9, wherein the kingpost shaft is disposed coaxially with the longitudinal axis of the center well of the spar hull.

13. The apparatus of claim 8, wherein the table has first and second ends, and wherein the means for limiting yaw movement of the table comprises:

a first pair of collinear guide shoes extending from opposite sides of the first end of the table;

a second pair of collinear guide shoes extending from opposite sides of the second end of the table, the collinear axes of the first and second pairs of guide shoes being laterally offset from the center of the table;

a third pair of collinear guide shoes extending from opposite ends and opposite sides of the table;

a fourth pair of collinear guide shoes extending from opposite ends and opposite sides of the table; the collinear axes of the third and fourth pairs of guide shoes being positioned radially with respect to the center of the table; and for each guide shoe, a respective bearing plate attached to the spar hull, wherein the guide shoe abuts the bearing plate.

14. The apparatus of claim 13, wherein each guide shoe comprises:

a base attached to the table, the base having an outer surface;

an elastomeric cushion attached to the outer surface of the base; and a slide plate overlying the elastomeric cushion.

15. The apparatus of claim 14, wherein each slide plate forms a segment of a horizontal circular cylinder in geometric shape.

16. The apparatus of claim 13, wherein the bearing plates comprise low friction material.

* * * * *

UNITED STATES PATENT AND TRADEMARK OFFICE
Certificate

Patent No. 6,648,074 B2 Patented: November 18, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Lyle D. Finn, Sugar Land, TX (US); Himanshu Gupta, Houston, TX (US); and Gerald W. Crotwell, Sugar Land, TX (US).

Signed and Sealed this Fifteenth Day of February 2011.

David J. Bagnell
*Supervisory Patent Examiner*
Art Unit 3672
Technology Center 3600